US006093121A

United States Patent [19]

Bishop et al.

[11] Patent Number: 6,093,121

[45] Date of Patent: Jul. 25, 2000

[54] SWIVEL CLAMP FOR RACKET STRINGING

[76] Inventors: Jonah C. Bishop; Paul Richard Bishop, both of 400 E. Loren, P.O. Box 1011, Frontenac, Kans. 66736

[21] Appl. No.: 09/179,602

[22] Filed: Oct. 27, 1998

[51] Int. Cl.[7] ..... A63B 51/14

[52] U.S. Cl. ..... 473/557

[58] Field of Search ..... 473/555, 556, 473/557; 24/516; 269/166, 169

[56] References Cited

U.S. PATENT DOCUMENTS

| | | | |
|---|---|---|---|
| 3,511,502 | 5/1970 | Spenle | 473/556 |
| 3,635,080 | 1/1972 | Krueger et al. | 473/556 X |
| 3,913,912 | 10/1975 | Smith | 473/556 |
| 4,376,535 | 3/1983 | Muselet et al. | 473/556 |
| 4,874,170 | 10/1989 | Zech | 473/557 |
| 5,026,055 | 6/1991 | Longeat | 473/556 |
| 5,080,360 | 1/1992 | Longeat | 473/556 |
| 5,090,697 | 2/1992 | Lee | 473/555 |

OTHER PUBLICATIONS

Ektelon "Model 'H' Owner's Manual" dated 1987.

*Primary Examiner*—Raleigh W. Chiu
*Attorney, Agent, or Firm*—Shook, Hardy & Bacon LLP

[57] ABSTRACT

A clamp for stringing rackets having conventional and fan pattern designs is provided. The clamp has a body, a support shaft and a base. The body has two members which cooperate to clamp a string therebetween. The body is pivotably received on the support shaft and may swivel about the shaft in both open and closed positions. The base is slidably received on a glide bar of a racket stringing apparatus and supports the shaft in a perpendicular orientation with respect to the glide bar.

20 Claims, 3 Drawing Sheets

SWIVEL CLAMP FOR RACKET STRINGING

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The present invention relates to a clamp for use in stringing rackets. More particularly, this invention relates to a racket stringing clamp which may pivot about its longitudinal thereby permitting the clamp to string not only conventional rackets where sets of strings are perpendicular to each other, but also allows it to string newer rackets which incorporate a fan design.

Racket sports have been around for hundreds of years. With the advent of the racket, is people have developed various ways to string the rackets. Regardless of the type of racket (e.g. badminton, squash, tennis, racquetball, etc.), all rackets share a few common characteristics. One characteristic that is shared by all rackets is that the tighter the racket is strung, or the tighter the strings are pulled, to a point, the greater the amount of energy transferred to the object struck by the racket. As such, people have developed various racket stringing apparatus that allow them to place greater amounts of tension on the racket strings. A common component of these apparatus arc a clamp of some sort which allows the user to clamp the string in place and keep tension on it while removing the end of the string from the tensioning device to thread the next portion of the racket.

Until just recently, another characteristic shared by all rackets was the orientation of the strings. Typically, the entire racket is strung using only one, or sometimes two, strings. The string is generally looped back and forth to create a set of parallel columns in a vertical orientation. The string is then weaved back through the columns in a horizontal orientation to create a set of parallel horizonal rows. Consequently, the horizontal columns and the vertical rows meet at right angles and the racket stringing apparatus which were designed to string various rackets were therefore designed to string rackets with the strings at right angles to each other.

Recently, however, rackets have been invented which place the vertical strings in a fan pattern (i.e. the vertical strings are closer to each other at the bottom of the racket then they are at the top of the racket). These rackets have been created based on the concept that if the same amount of effort is placed on a long string and a short string, the long string will stretch further and thereby store more potential energy. The greater potential energy transfers to greater kinetic energy when the potential energy is released into the ball. Because a longer string creates more power than a short string, racket manufactures have worked on ways to increase string length in a standard racket. One way racket manufactures have found to increase string length is to angle the vertical strings towards the center or the base of the racket (i.e. towards the handle). Wile angling the vertical strings in a fan patterns does create longer strings and therefore more energy, the vertical strings are no longer at right angles to the horizontal strings. This had created a problem in the stringing process.

Conventional racket stringing apparatus provide a table above which the racket is mounted in a horizontal orientation. The table has a glide bar which supports a clamp thereon for gripping and maintaining the string in a taught position during the stringing process. As racket strings used to always be perpendicular to each other, the tables were designed so that the glide bar and hence the clamp could only be oriented in two positions which were perpendicular to each other. This has created a problem when attempting to string a new racket incorporating the fan pattern on the standard racket stringing apparatus.

When one tries to string the vertical strings on a racket with the new fan pattern, the string is no longer parallel to a line extending from the base of the handle to the top of the head and the string is therefore no longer parallel to the glide bar or the jaws of the clamp. As such, when one clamps the string with the standard clamp, a kink is placed in the string and the string is no longer straight from one side of the racket to the other. The kink in the string creates and excess amount of string between both sides such that when the clamp is released, tension in the string is lost. The loss of tension in the string translates to a loss of power and therefore counteracts the benefits gained by making the vertical strings longer.

Therefore, there is a need for a clamp which may be used on a standard racket stringing apparatus which will rotate to grasp strings at a variety of angles. The present invention overcomes the drawbacks of the prior art and fills these and other needs.

BRIEF SUMMARY OF THE INVENTION

It is a general object of the present invention to provide a clamp which can rotate about its own longitudinal axis.

It is an object of the present invention to provide a clamp which includes a clamp body and a base whereby the clamp body may move toward and away from the base.

Another object of the present invention is to provide a clamp which includes a base having a passage therethrough for slidably receiving a glide bar of a racket stringing apparatus whereby the passage has a tight tolerance about the glide bar such that the base will not slide along the glide bar when a moment is applied to the base at a distance away from the passage.

A further object of the present invention is to provide a clamp which can rotate about its own axis, move toward and away from its own base, and move along a glide bar of a racket stringing apparatus in both the clamp's open and closed positions.

A still further object of the present invention is to provide a clamp which permits one to string a racket wherein the vertical strings are not perpendicular to its horizontal strings.

In order to overcome the above-stated problems and limitations, and to achieve the noted objects, there is provided a racket stringing clamp having a base and a separate clamp body which permits the body to rotate about an axis generally perpendicular to the base.

In general, the clamp comprises a clamp body, a shaft, a base, and a lever. In the preferred form, the clamp body has a first member which is supported on the shalt, and a second member which is supported on the first member for movement toward and away from the first member to allow the first and second member to cooperate to securely grasp a string of a racket. The clamp is supported on the racket stringing apparatus by slidably receiving a horizontal glide bar of the apparatus in a passage through the base. The base supports the shaft in a generally perpendicular orientation to the glide bar and the shaft supports the clamp body. Because the clamp body is supported on the shaft, the clamp body can rotate about the shaft in a plane generally parallel to the glide bar and can also move toward and away from the glide bar in a generally perpendicular direction.

Further objects, features, and advantages of the present invention over the prior art will become apparent from the detailed description of the drawings which follows, when considered with the attached figures.

BRIEF DESCRIPTION OF THE SEVERAL VIEWS OF THE DRAWING

The objects and features of the invention noted above are explained in more detail with reference to the preferred embodiment illustrated in the attached drawing figures, in which like reference numerals denote like elements, and in which.

DETAILED DESCRIPTION OF THE INVENTION

Figure 1:
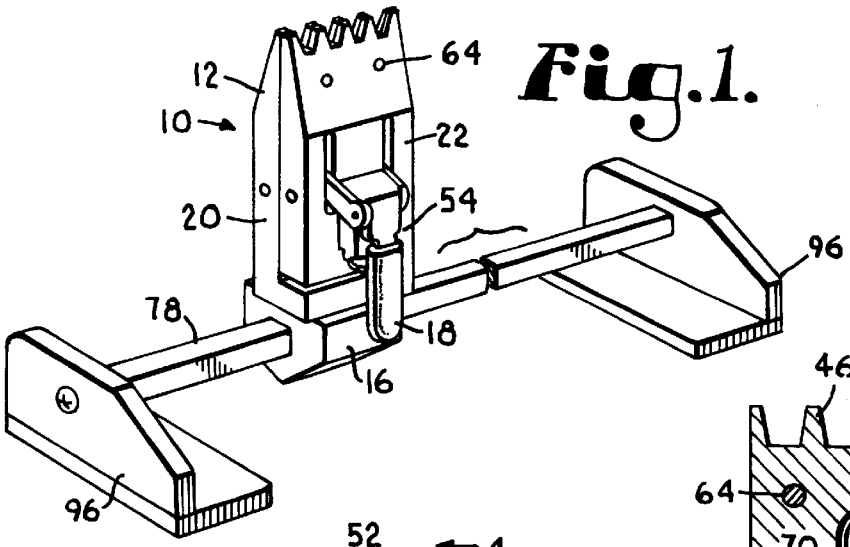
FIG. 1 is a perspective view of a clamp constructed in accordance with the preferred embodiment of the present invention, illustrating the clamp supported on a glide bar.
Figure 3:
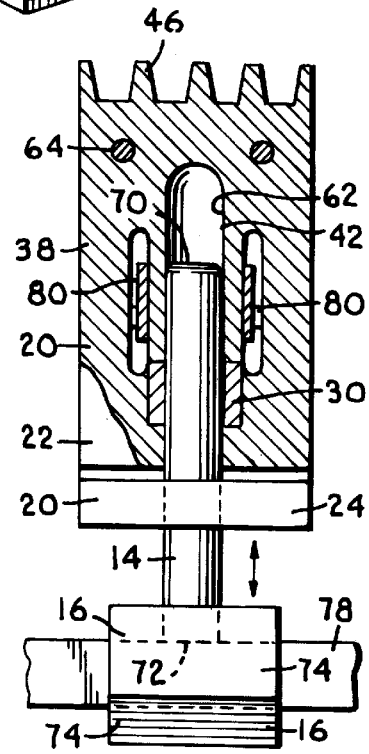
FIG. 3 is a front elevational view of the clamp of the preferred embodiment, illustrating first and second clamp members forming a part thereof, the clamp members being partially cut away to illustrate a shaft received in the members.

Referring initially to FIG. 1, numeral 10 generally designates a racket stringing clamp constructed in accordance with the present invention. The clamp 10 is primarily comprised of a clamp body 12, a support shaft 14 (shown in FIG. 3), a base 16, and a lever 18.

Figure 6:
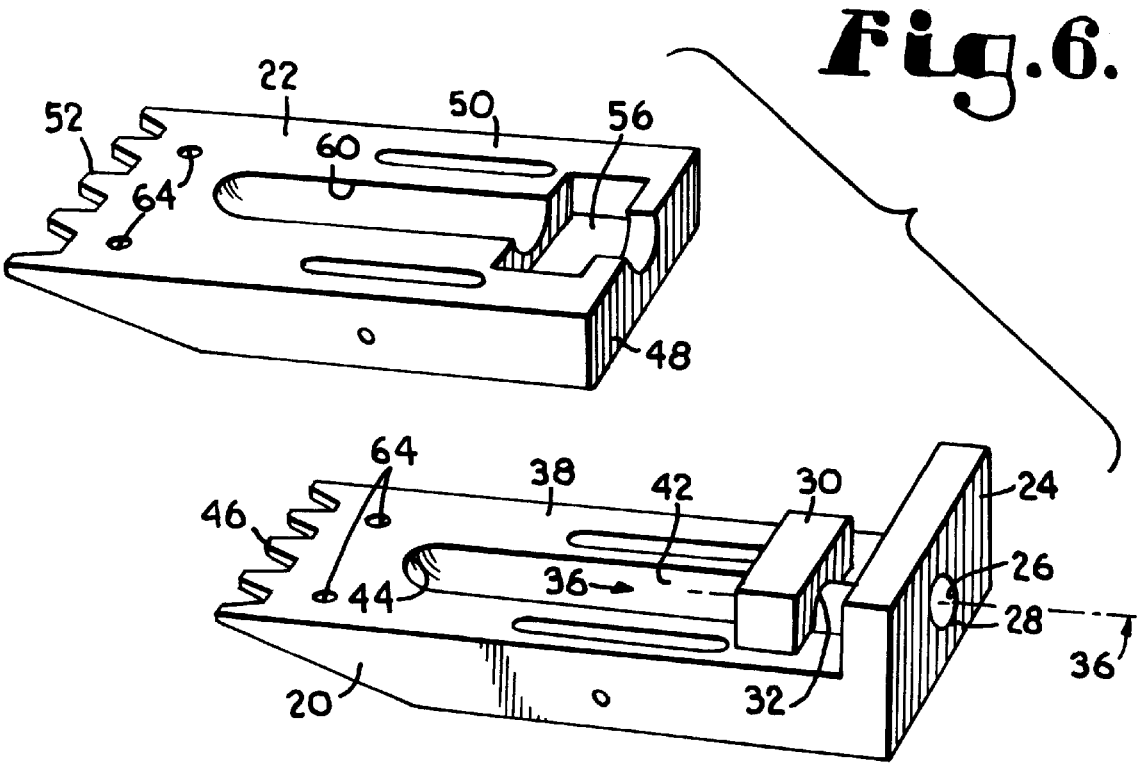
FIG. 6 is a exploded perspective view of the clamp body of the preferred embodiment having the second clamp member laid open to better illustrate an interior face of each clamp member.
Figure 7:
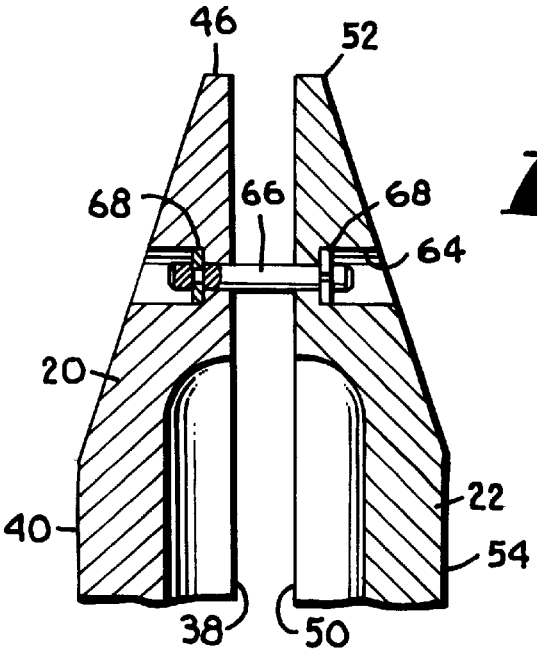
FIG. 7 is a fragmentary cross-sectional side view of the clamp body of the preferred embodiment, illustrating an alignment pin.

The body 12 preferably has a first member 20 and a second member 22 which mate in cooperating fashion to facilitate grasping of a string therebetween. The first member 20, as best illustrated in FIG. 6, is preferably "L" shaped and has a bottom or leg portion 24. A bore 26 is located in the leg portion 24 of the first member 20 and is preferably located on a longitudinal axis of the first member 20. The bore 26 defines an inner circumferential bearing surface 28.

The first member preferably also includes a block 30 in spaced relationship with the leg portion 24. The block 30 has a hole 32 therein, the hole 32 being located on the longitudinal axis of the first member 20 and in alignment with the bore 26 whereby a straight line opening 36 is formed by alignment of the bore 26 and the hole 32. The hole 32 in the block 30 defines a second inner circumferential bearing surface 34 in the first member 20.

The first member 20 preferably further includes a inner face 38, an outer surface 40 and a channel 42. The channel 42 is in the inner face 38 and runs along the longitudinal axis of the first member 20, from the leg portion 24 to an end point 44, the end point 44 being located adjacent a top portion 46 of the first member 20.

The first member 20 may be formed from a solid piece of stock. In such case, the bore 26, the hole 32 and the channel 42 in the first member 20 may be formed at the same time by drilling into the stock. Material may then be removed from the stock to create the leg portion 24, the block 30 and the channel 42. It should be noted that the opening 36 which receives the shaft 14 need not be on a central longitudinal axis of the body but may be on any longitudinal axis of the body 12.

The second member 22 has a bottom face 48, an inner face 50, a top portion 52 and an outer surface 54. The inner face 50 of the second member 22 preferably includes a recess 56. The recess 56 is adapted to receive the block 30 of the first member 20 when the two clamp members 20, 22 are placed in mating cooperation to facilitate the grasping of a string 58 therebetween. In this arrangement, the inner face 38 of the first member 20 faces the inner face 50 of the second member 22.

The second member 22 preferably further includes a channel 60 located longitudinally along the second member 22 and most preferably along the longitudinal axis of the second member 22. When the second member 22 mates with the first member 20, the channels 42, 60 of the two members 20, 22 align to form a cavity 62. The cavity 62 is in alignment with the opening 36 in the first member. It should be noted that, in an alternate embodiment, the opening 36 may be contained entirely within the first member and no channels 42, 60 would then be necessary. It has, however, been found preferable to have the opening be on the central longitudinal axis of the body 12.

The first and second members 20, 22 preferably also each include two alignment pin holes 64 near the top portions 46, 52 of each member 20, 22, whereby an alignment pin 66 may be placed in each set of mating pin holes 64 to maintain alignment of the inner face 50 of the second member 22 with the inner face 38 of the first member 20 as the second member 22 is moved toward and away therefrom in a direction generally perpendicular to the longitudinal axis of the first member 20 between open and closed positions. The alignment pins 66 may be retained in the pin hole 64 by using split rings 68.

The support shaft 14 is preferably an elongate member having a circular cross-section. The shaft 14 has a top end 70 and a bottom end 72. The top end 70 of the shaft 14 is preferably rounded to facilitate receiving of the shaft 14 in the opening 36 and the cavity 62 in the body 12. The body 12 is thereby supported on the shaft 14 and may rotate on the shaft and slide up and down it. The base 16 is preferably comprised of a block member 74 having a passage 76 there through. The passage 76 preferably has a square cross-section and is designed to slidably receive a glide bar 78 that also has a square cross-section. The shaft 14 is attached to the base 16 at its bottom end 72 and extends therefrom in a direction generally perpendicular to the passage 76.

While the base 16 is designed to slide along the glide bar 78, the tolerance between the passage 76 and the glide bar is very tight. This close fit is necessary in the present clamp design because, unlike known clamps which clamp themselves to both the string and the glide bar during the clamping process, the present clamp 10 prevents movement of the clamp along the glide bar 78 during the stringing process by means of a binding action.

Figure 2:
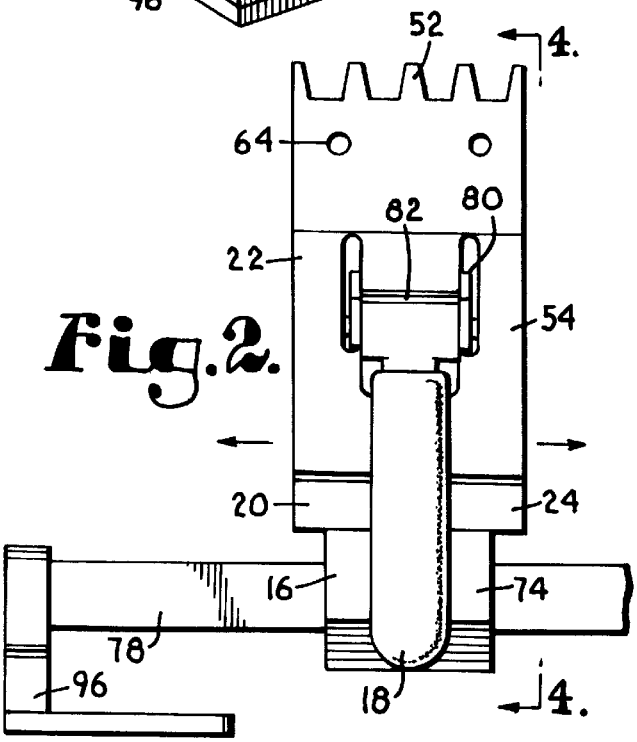
FIG. 2 is a front elevational view of the clamp of the preferred embodiment slidably received on a horizontal glide bar, illustrating the directions in which the clamp may slide along the glide bar.

Looking at FIG. 2, if a horizontal force is applied to the base 16 in a direction parallel to the glide bar 78, the clamp 10 will easily slide along the glide bar 78. However, if the same force is applied in the same direction but at a distance along the clamp spaced away from the base, for example at the top portions 46, 52 of the clamp members 20, 22 such as by pulling on a string 58 clamped in the clamp 10, the moment on the clamp away from the base will cause the clamp to attempt to rotate about the base 16 within a plane that includes the axis of the glide bar. Because of the tight tolerance between the passage and the glide bar, however, the moment on the body 12 will cause the base to bind on the glide bar 78 and thereby prevent sliding movement along the glide bar. Additionally, if the glide bar is not allowed to rotate, a moment on the body in a direction perpendicular to the glide bar will not move the clamp because the square passage will prevent the base 16 from rotating about the glide bar.

Figure 4:
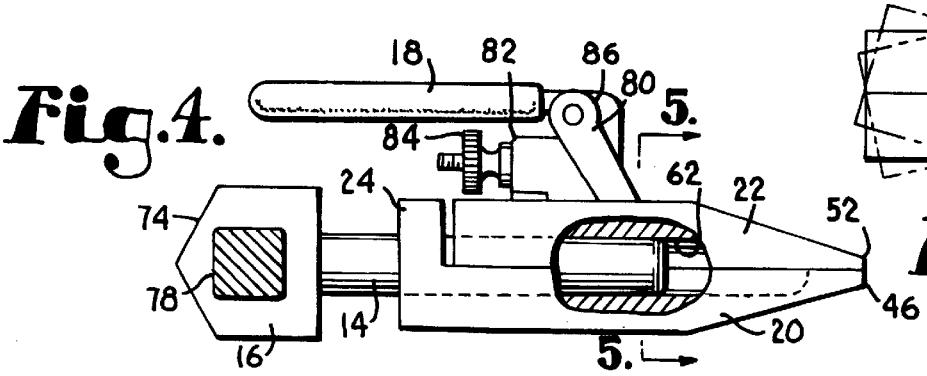
FIG. 4 is a side elevational view of the clamp of the preferred embodiment taken generally along the line 4—4 on FIG. 2 and having parts cut away to show particular details of the structure.
Figure 5:
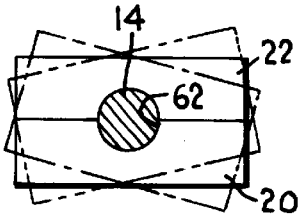
FIG. 5 is a plan view of the clamp of the preferred embodiment, illustrating its ability to pivot about a longitudinal axis.

The lever 18 is of a type known in the art. Lever 18 has two lever arms 80, an adjustment block 82 and a clamp pressure adjustment nob 84. The lever arms 80 are attached on one end to the first member 20 and on another end 86 to the adjustment block 82. When the lever 18 is generally parallel to the shaft 14, as it is in FIG. 4, the clamp 10 is in a closed or clamping position. When the lever is moved to a generally perpendicular orientation to shaft 14, the clamp 10 becomes in an open position and the second member 22 is capable of moving away from first member 20 in a generally perpendicular direction.

The clamp 10 of the present invention is adapted for use on a racket stringing apparatus 90. The apparatus 90 has a support table 92, a tensioning member 94, glide bar brackets 96, and hold-downs 98. The racket 88 has a frame 100 having a plurality of holes or eyelets 102 therein which the string 58 passes therethrough, a handle 104 and a head 106. The head 106 has a top 108 and a bottom 110, the bottom portion 10 being adjacent the handle 104.

The user secures the racket 88 to the racket stringing apparatus 90 by means of the hold-downs 98. In this position the racket is parallel to the support table 92 and the glide bar 78 and all are in a generally horizontal orientation. The user then begins to thread the string for the vertical strings (the strings that run from the top of head to handle). Generally a racket is strung with the vertical strings first and then the horizontal strings second. The vertical strings are strung from the inner and center most strings working outward to the edges of the racket. Stringing the vertical strings requires the user to use two clamps simultaneously.

Figure 8:
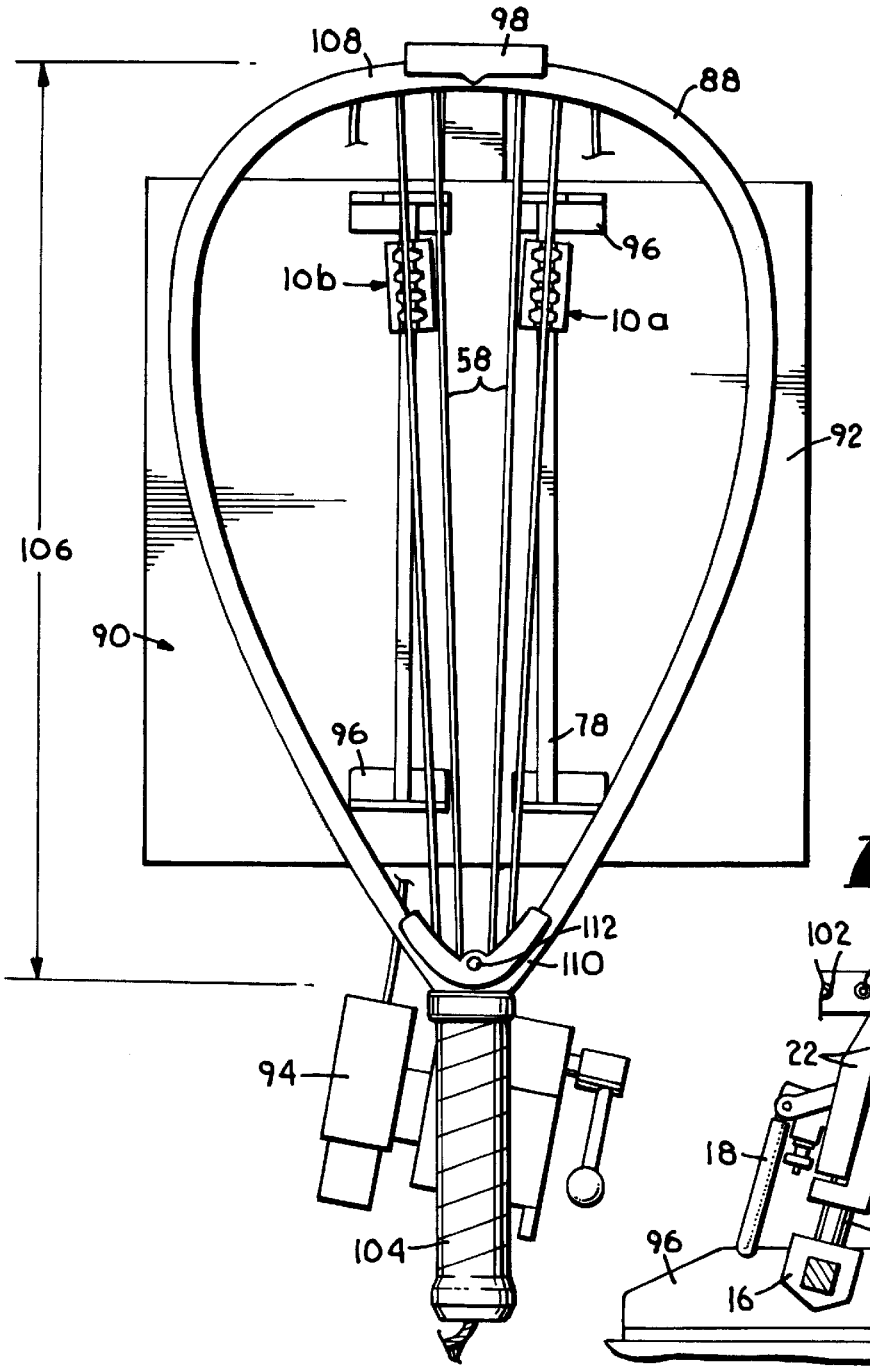
FIG. 8 is a plan view of a racket stringing apparatus utilizing two clamps of the preferred embodiment to string a racket incorporating a fan pattern.
Figure 9:
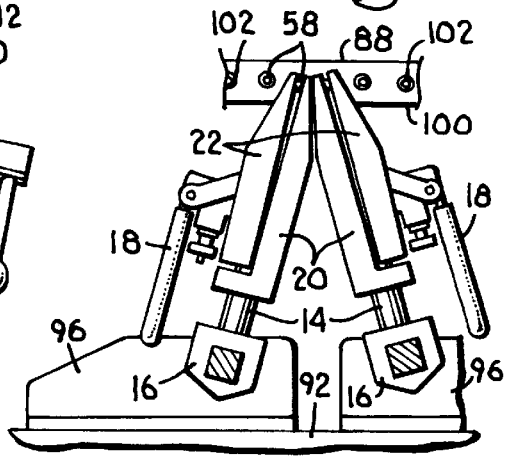
FIG. 9 is a side view of the racket stringing apparatus of FIG. 8.

In the racket shown in FIG. 8, the user starts by wrapping the string around a pin 112 located at the bottom 110 of the head 106. The string is then taken up on both sides towards the top 108 of the head. Each length of the string is then taken through and eyelet 102 in the frame 100. Each length of this string is then doubled back towards the handle 104 and brought back down through the next adjacent eyelet towards the respective edges of the racket. Both strings are then brought back down towards the handle 104. The string now has two parts, a portion to the right of center and a portion to the left of center. The portion of string on the right is then clamped by the clamp on the right 10*a* (The letters "a" and "b" have been added to certain numbers in FIG. 8 for clarification of right and left respectively). The portion of the string on the left is then connected to the tensioning member 94 for tensioning. The user then places the appropriate amount of tension on the string 58 and the string is drawn taught from the tensioning member 94 to the point where it is clamped off by clamp 10*a*. At this point, two of the vertical strings would be in place and drawn to the desired tension amount.

The user then takes the clamp on the left 10*b* and clamps along the string between the tensioning member and the right clamp 10*a*. Once the string is clamped in two places, the user may then remove the string from the tensioning member and the desired amount of tension will still be on the portion of the string which extends between the two clamps. At this point the user may then weave the loose end of the portion of the string on the left through the next available eyelet in the frame, place the free end in the tensioning member, and place tension on the string. Once tension is placed on the string, the user may remove the left clamp 10*b* attached to the string between the right clamp 10*a* and the tensioning member 94. The user may then move the free clamp over one column and re-clamp the string.

By alternating sides of the racket, the user may string and tighten the string from the center of the racket to the edges by repeating the steps of tensioning, clamping, weaving, and retensioning until all of the vertical strings are strung. At that point, the user ties off one of the ends of the string and the other end of the string may be used to string the horizontal rows in a similar fashion. Stringing the horizontal strings requires the use of only one clamp.

From the foregoing it will be seen that this invention is one well adapted to attain all ends and objects hereinabove set forth together with the other advantages which are obvious and which are inherent to the structure. It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

What is claimed is:

1. A clamp for use in a racket stringing apparatus, comprising:

a support shaft defining a longitudinal axis;

a first clamp member defining a longitudinal axis which is generally parallel to the longitudinal axis of the support shaft, the first clamp member being generally "L" shaped and having a bore through a leg portion thereof, the bore receiving the shaft, wherein the first clamp member is supported on the shaft for pivotal movement about the shaft; and a second clamp member supported on the first clamp member for movement toward and away from the first clamp member in a direction generally perpendicular to the longitudinal axis of the shaft between open and closed positions.

2. The clamp of claim 1, further comprising a base attached to a proximal end of the shaft.

3. The clamp of claim 2, wherein the base has a passage therethrough, the passage being a generally perpendicular to the shaft.

4. The clamp of claim 1, wherein the clamp members may rotate about the longitudinal axis of the shaft in both the open and closed positions.

5. The clamp of claim 2, wherein the clamp members may move along the shaft toward and away from the base in both the open and closed positions.

6. The clamp of claim 1, further comprising means for biasing the first and second clamp members towards each other.

7. The clamp of claim 6, wherein the means for biasing is a lever.

8. A clamp to be used with a racket stringing apparatus having a horizontal glide bar for supporting the clamp, the clamp comprising:

a clamp body having first and second clamp members and the body having a bore therein, the bore to be generally perpendicular to the glide bar;

a base having a passage adapted to receive the glide bar; and a shaft having distal and proximal ends, the distal end connected to the base and the proximal end received in the bore of the body to permit the body to pivot about the shaft.

9. The clamp of claim 8, wherein the bore in the body is at least partially intermediate the first and second clamp members and is at least partially defined by corresponding channels in the first and second clamp members.

10. The clamp of claim 8, wherein the first and second clamp members of the clamp body are movable toward and away from each other between open and closed positions and wherein the body may pivot about the shaft in both the open and closed positions.

11. The clamp of claim 8, wherein the first and second clamp members of the clamp body are movable toward and away from each other between open and closed positions and the clamp body may move toward and away from the base, in a generally perpendicular direction, along the shaft in both the open and closed positions.

12. The clamp of claim 8, wherein the bore is in the first clamp member, the first clamp member is supported on the shaft for pivotal movement about the shaft and the second clamp member is supported on the first clamp member for movement toward and away from the first clamp member in a direction generally perpendicular to a longitudinal axis of the shaft between open and closed positions.

13. The clamp of claim 8 wherein the first and second body members each have a channel, the channels mutable to form a cavity, the cavity aligned axially with the bore.

14. A clamp for stringing rackets comprising:

a first clamp member having a top jaw portion, an inner face and a bore, the bore defining an inner circumferential bearing surface; and a second clamp member having a top jaw portion, an inner face, and a slot, the slot being in the inner face of the second clamp member, the top jaw portions of each clamp member aligning with each other and the inner face of the second clamp member cooperating with the inner face of the first clamp member to facilitate the grasping of a racket string therebetween.

15. The clamp of claim 14, wherein the bore is longitudinal.

16. The clamp of claim 14, wherein the first clamp member has a longitudinal channel on its inner face and the second clamp member has a longitudinal channel on its inner face, the channels mutable to form a cavity, the cavity aligned axially with the bore.

17. The clamp of claim 14, wherein the first clamp member further includes a block having a hole therethrough, the hole defining a second inner circumferential bearing surface in the clamp, the hole being spaced axially from the bore to form a straight opening therethrough.

18. The clamp of claim 17, wherein the second clamp member further includes a recess for receiving the block of the first clamp member in mating relationship.

19. The clamp of claim 14, further comprising an elongate shaft received in the bore of the first clamp member, the bore acting as a bearing and permitting the first clamp member to rotate thereabout.

20. The clamp of claim 19, further comprising a base attached to an end of the shaft, the base having a passage therethrough adapted to receive a glide bar of a racket stringing apparatus.

* * * * *